US006039191A

United States Patent [19]

Purnell

[11] Patent Number: 6,039,191

[45] Date of Patent: Mar. 21, 2000

[54] KITCHEN RACK

[76] Inventor: Robert C. Purnell, 4 Maynard Cir., Old Saybrook, Conn. 06475

[21] Appl. No.: 08/886,928

[22] Filed: Jul. 2, 1997

Related U.S. Application Data

[60] Provisional application No. 60/021,053, Jul. 2, 1996.

[51] Int. Cl.[7] ..... A47E 5/00

[52] U.S. Cl. ..... 211/118; 211/113; 211/70.7; 211/85.29

[58] Field of Search ..... 211/113, 118, 211/117, 189, 70.7, 85.29; 248/317, 339

[56] References Cited

U.S. PATENT DOCUMENTS

| | | | |
|---|---|---|---|
| 402,885 | 5/1889 | Babcock | 211/113 |
| 643,818 | 2/1900 | Headland | 211/113 |
| 1,869,238 | 7/1932 | Coutts | 211/113 |
| 4,290,531 | 9/1981 | Lazaraus | 211/85.29 |
| 4,314,646 | 2/1982 | Purnell | 211/113 |
| 4,325,486 | 4/1982 | Neal | 211/85.29 |

OTHER PUBLICATIONS

R.C. Purnell Co "Rack Magic" Brochure 3 pages.

*Primary Examiner*—Robert W. Gibson, Jr.
*Attorney, Agent, or Firm*—C. G. Nessler

[57] ABSTRACT

A rack, from which kitchen utensils and other things may be hung for storage, is comprised of side panels and end panels. Bars that support hooks from which the utensils hang run lengthwise between the end panels. Stiffeners run lengthwise in a groove along each side panel, and the stiffener ends fit snugly into grooves of the end panels, to provide strong corner joints. Cross pieces, to support at intermediate points the bars, run lengthwise between the side panels. They are fastened to the side panels using dowels, while fitting tightly against the underside of opposing stiffeners. Rack side panels may be initially fabricated as precursors having standard length and width dimensions, to then be easily modified at the factory or in the field, and to enable the making of custom length and width racks. The rack design features enable economic factory fabrication, so racks can be shipped as knocked down units that can be conveniently modified and assembled in the field.

16 Claims, 5 Drawing Sheets

KITCHEN RACK

This application claims the benefit of Provisional application Ser. No. 60/021,053, filed Jul. 2, 1996.

TECHNICAL FIELD

The present invention relates to racks for housewares, more particularly to racks from which kitchenware and other things may be hung.

BACKGROUND

One way of conveniently storing utensils, cups, pots, pans, small cookware, and the like which are used daily in the kitchen, is to hang such things from suspended hooks convenient to the cook. In modern domestic kitchens it is desired that the suspended hooks be integrated into a pleasing fixture. One way in which this has been carried out is by constructing a rectangular frame having rails or bars running the length of the frame, within the interior space of the frame, and hanging the metal hooks from the bars. See FIG. 1. The rack itself is hung from the ceiling or otherwise suspended or attached to another structure. Often, the rack has an open platform at its top, so things can be laid there.

While such kinds of racks can be custom made, it is of course desirable that they be prefabricated in a factory setting, to obtain the economic advantage of routine production. However, when making prefabricated racks, it becomes a problem of meeting the demands of customers for different sizes to suit a variety of kitchen arrangements.

It is also desirable for racks to be shipped in a knocked-down rather than assembled condition, to lower packaging, shipping and storage costs. Knocked-down racks also can enable the purchaser to make some custom field changes, and apply a custom finish. However, when a rack is constructed so it can be shipped in knocked-down condition, there are necessary compromises made in how the components join together. As a result, a rack assembled from knocked-down components may not be sufficiently sturdy, light in weight, or low in cost.

Thus, there has been a need for a rack construction which is adaptable to modification both in the factory or field, but which at the same time is economic, lightweight, and easily assembled in the field to make a sturdy rack.

SUMMARY

An object of the invention is to provide a rack which can be simply assembled from low cost components, but which is sturdy and pleasing in appearance. Another object of the invention is to enable mass produced kitchen racks and the like to be conveniently modified in the factory or field, to meet the needs of those who want custom dimension racks, and which at the same time look custom made and provide the benefits of prior art racks.

In accord with the invention, an improved rack is of the type wherein a frame comprised of multiple panels join together to define a space. Members, such as one or more bars, are fastened and running lengthwise within the space. Hooks are hung from the bars and kitchenware may be hung from the hooks. The rack improvement comprises at least one panel to which there is attached a stiffener running lengthwise and projecting laterally into the space; and, the end of the stiffener engages a groove in an adjacent panel, to form a strong joint. Preferably, a rack is comprised of mating panels, all having lengthwise grooves; thus, the stiffener fits into the groove of one panel and at its end engages the groove of the mating panel in vicinity of the joint. Preferably, the stiffeners run the whole length of the side panel, to stiffen the panel as well as the joint between the panels.

The invention is useful with different configurations of racks. Preferably, the rack is rectangular with a corner joint which is a right angle butt joint; the rack has at least one rod running the length of the frame, parallel to and spaced apart from the side panel; the rod is supported by one or more cross pieces running parallel to the end panels; and, the top of each cross piece is fastened to the cross section of the stiffener where it projects laterally from the side panel. Preferably, the groove in the side panel does not extend to the very end of the panel, so the groove is not visible from the exterior. Alternatively, the stiffener has a stepped end with a projecting tab; and the tab fills the side panel groove where it runs within the butt joint.

Preferably, the rack has slats fitted in and running between the opposing grooves of the end panels, and the tops of the slats and tops of the opposing stiffeners are at the same elevation, to provide a surface within the enclosure of the rack frame on which things may be mounted.

In accord with an invention, a rack can be fabricated in parts along the lines just described and shipped in knocked down condition. The design of the rack enables making custom side panels from larger precursor side panels having a groove and a pattern of dowel hole. The custom side panel will have the previously drilled pattern of holes symmetrically positioned along its length, to give a pleasing even arrangement of the cross pieces which fasten with dowels, set into the dowel holes of the side panel. Side panels can also be fabricated with different widths (heights) using precursor panels having one or more lengthwise grooves.

The rack of the invention meets the requirements of being amenable to easy change in dimension, being economic, and being sturdy when assembled.

The foregoing and other objects, features and advantages of the invention will become more apparent from the following description of the best mode of the invention and accompanying drawings.

DESCRIPTION

Figure 1:
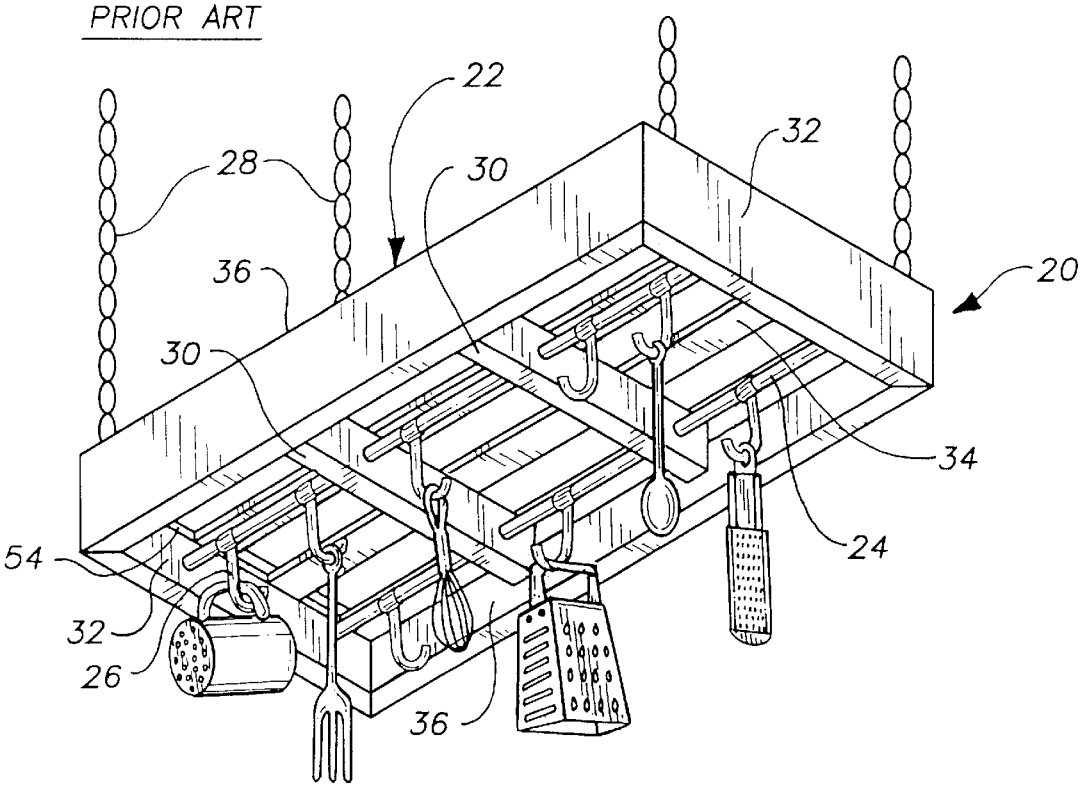
FIG. 1 PRIOR ART
FIG. 1 shows a prior art rack.

FIG. 1 shows a prior art rack 20 upon which the present invention is an improvement. See also the rack of U.S. Pat. No. 4,324,646 to Purnell, the applicant herein. The rack of FIG. 1 is comprised of a rectangular wood frame 22 within which run one or more parallel round brass rods 24. The rods are supported by flat bottom holes in the end panels 32 and run through holes in two cross pieces 30 which run between the side panels 36 in the interior of the frame. Like the end panels, the side panels 36 are flat boards. Hanging from the rods are moveable hooks 26 from which are suspended kitchen utensils, fragmentarily shown in the Figure. The configuration of rod and hooks is preferably in accord with the teachings of the aforementioned Purnell patent, the disclosure of which is hereby incorporated by reference. The rack outer frame of side panels is suspended by chains 28, or rods, etc. The opposing inside face of each end panel 32 has a groove 35. Slats 34 are captured at each end within the grooves 54, as they run lengthwise along the rack. The slats are tacked to the cross pieces 30 to hold them in place. The slats provide a surface across the top part of the frame upon which dishes and the like can be laid. But at the same time, when viewed from below, the spaced apart slats desirably maintain an open appearance, letting light through. The side panels, end panels and cross pieces may be connected by a one of, or a combination of, nails, screws, biscuits, dowels, glue, and the like.

Figure 2:
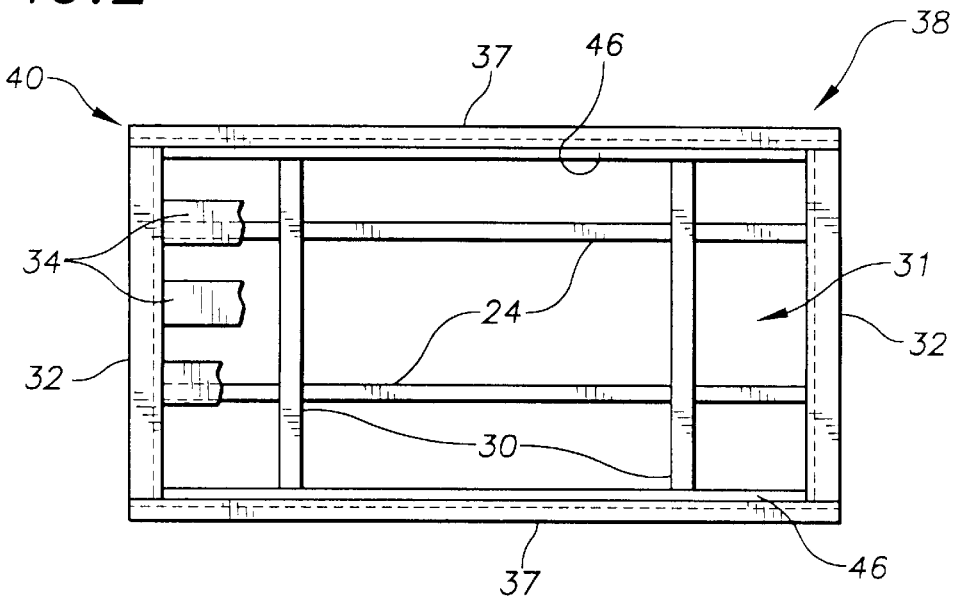
FIG. 2 shows is a top view of a rack embodiment of the invention.
Figure 3:
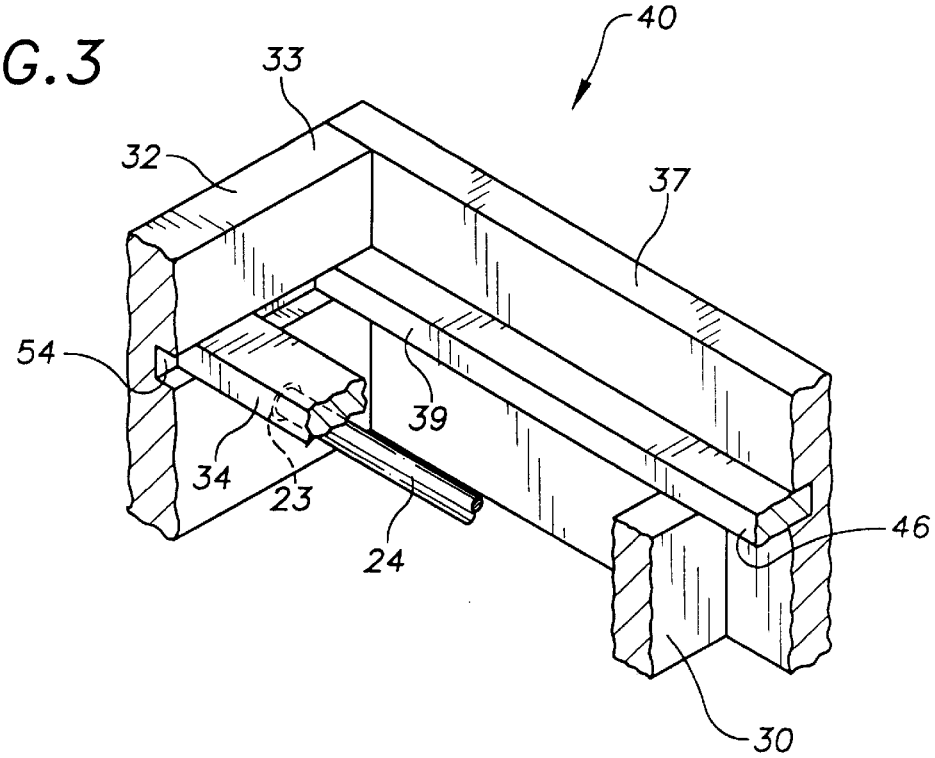
FIG. 3 is a perspective view of one corner of the rack of FIG. 2, where the end panel butts against the side of the side panel.
Figure 4:
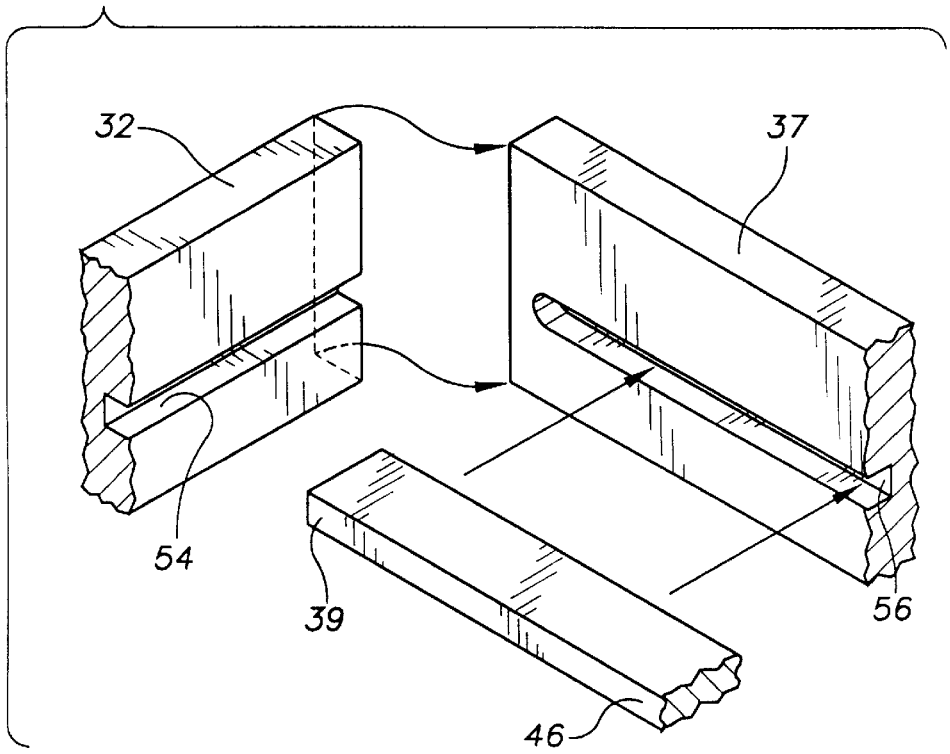
FIG. 4 shows parts of the corner of FIG. 3 in exploded view, showing the tab on the end of the stiffener which fills the groove within the butt joint.

FIG. 2 shows in top view rack 38 embodying certain features of the invention. The rack has generally the same arrangement of essential components, opposing side panels 37 and opposing end panels 32 fitted together to form a rectangular frame having and open interior space. Within the space 31, lengthwise slats 34 fit in end panel grooves 54, and lengthwise bars 24 fit in shallow holes 23 in the end panel. A principal difference between the rack of FIG. 2–6 and the prior art rack of FIG. 1 relates to lengthwise stiffeners 46 and how they strengthen the corner joint. FIG. 3 shows in perspective the interior of a corner 40 of the rack 38. FIG. 4 shows the corner 40 in exploded view.

Referring to FIG. 2–6, a right angle corner joint is formed between the butt end 33 of the end panel 32 and the side or interior vertical face of the side panel 37. Each side panel 37 has a lengthwise rectangular cross section groove 56 running along its inner-facing surface. Fitted, and preferably glued, within the side panel grooves are rectangular cross section stiffeners 46. Each stiffener has a cross section depth greater than the groove depth, and thus the stiffener projects inwardly, toward the central space, from the interior facing surface of the side panel. Within the generality of the invention the stiffener may be adhered to the vertical surface of side panel, as discussed in connection with FIG. 11, below. Preferably, the stiffener runs along the full length of the side panel, but it will be appreciated that where stiffening of the entire side panel length, i.e, the center, is not needed, the stiffeners may be shorter segments running along the side panels near the joints with the end panels.

Preferably, the stiffener is set in a router-formed groove 56 like that shown in FIG. 4, and its length is slightly less than the length of the side panel. The groove terminates a very short distance from the end of the side panel 37, so that when the joint is formed no groove is visible from the exterior. As shown by FIG. 3, the preferred stiffener has a square end 39, which upon assembly of the frame, fits snugly into the groove 54 of the end panel, thus locking the panels together and strengthening the corner joint. Gluing, nailing, stapling, screwing and/or doweling may be used to hold the corner joint together. However, in the invention the strength provided by the stiffener to the joint, when used with glue, reduces the requirement for the other joint strengthening fasteners such as nails. Alternately, dowels without glue may be used.

Figure 5:
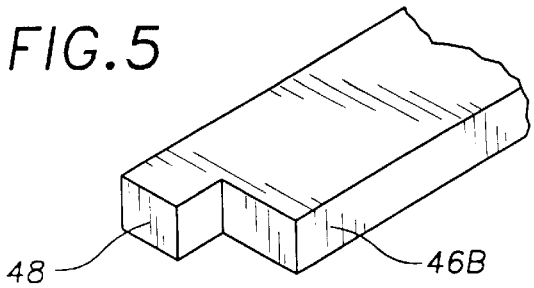
FIG. 5 is a perspective view of a stiffener having a stepped end.
Figure 6:
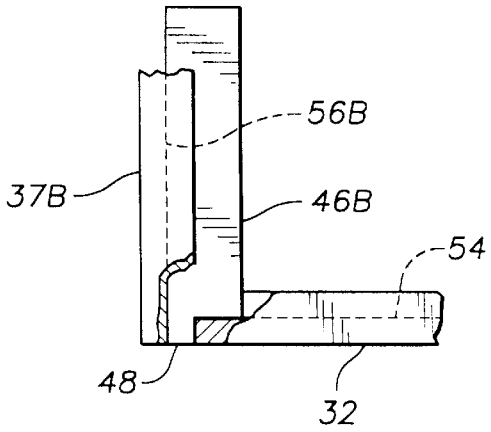
FIG. 6 shows a partial cutaway top view of corner of FIG. 3.
Figure 9:
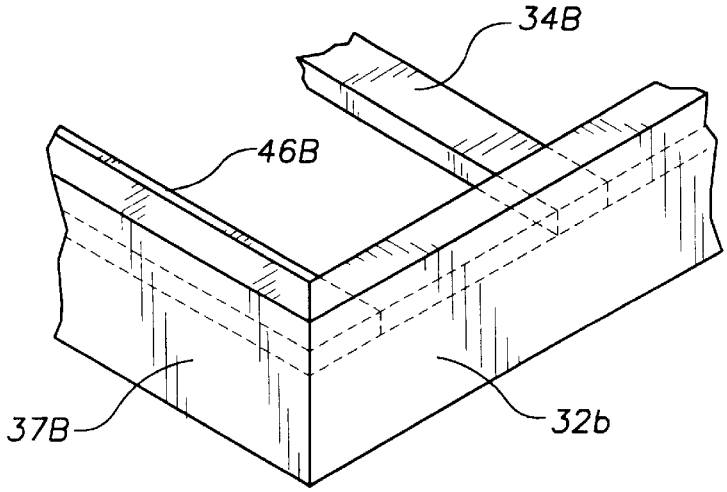
FIG. 9 shows an oblique or mitered corner joint in top view.

Referring to FIG. 5–6, an alternate embodiment stiffener 46B may have a stepped end comprised of a small dimension tab 48, while the side panel 37B has a groove 56B running the entire length of the side panel. Upon assembly, the stepped end of the stiffener fills the groove space where the side panel and end panel form a butt joint. See FIG. 6. This provides a pleasing appearance when the frame is viewed from the exterior. Of course, if the corner joint is mitered it is not necessary to have a stepped end to fill the end of the groove opening, since there is no exposed groove end opening. See FIG. 9 as a reference.

The invention will be applicable to other shape frames than rectangular: For instance, triangular or pentagonal, where the corners will not be at 90 degree angle. The top view of FIG. 9, which generally corresponds with the view of the right angle corner in FIG. 6, illustrates such an oblique angle joint. The stiffener 46B runs in a groove along panel 37B so its oblique end intersects and locks into the groove of panel 32B.

Figure 7:
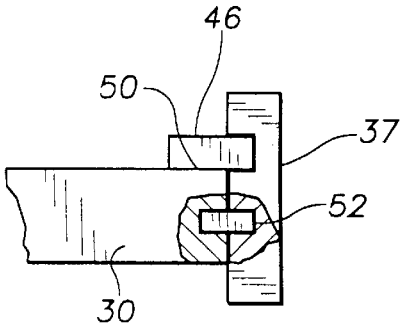
FIG. 7 how a cross piece is attached to the side panel by a dowel and to the stiffener by glue or a fastener.

As shown in FIG. 7, the top edge 50 of typical cross piece 30—for supporting the bars on which hooks hang, is secured in place so it contacts the underside of the inwardly projecting part of the cross section projecting stiffener 46. The joint between the two pieces 30, 46 is fastened by glue, or preferably, a brad. The cross piece is also secured to side panel 37 by means of a single glueless dowel 52. Ordinarily two dowels would be used for the cross piece to secure it against rotation. In the design shown in FIG. 7 the manufacturing cost and comparative criticality of dimension is avoided. Even when glue or a brad is not used to secure the top of the cross piece to the underside of the stiffener, the positioning of the cross piece against the stiffener, in combination with the single dowel, will prevent the cross piece from tending to rotate.

Figure 11:
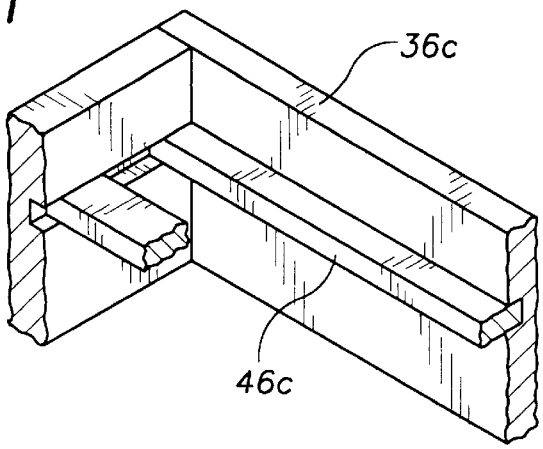
FIG. 11 shows a joint like that of FIG. 3, but where the stiffener is fastened to the surface of the side panel instead of running in a groove.

FIG. 11 is like FIG. 3 but shows a different rack embodiment wherein stiffener 46C runs along the surface—and not in a groove—of side panel 36C, to intersect and lock into groove 54C of end panel 32C. Stiffener 46C may be fastened to the side panel by glue or other means. Typical slat 34C, like those described below in connection with FIG. 2–6, has a top elevation substantially the same as that of the top of the stiffener.

Figure 8:
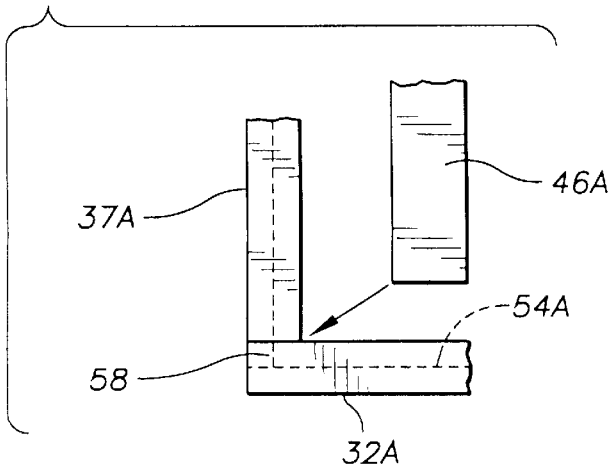
FIG. 8 shows an alternate corner joint configuration, where the end of the side panel butts against the side of the end panel.

FIG. 8 shows a less preferred alternate construction in which the end of the grooved side panel 37A butts against the side face of the grooved end panel 32A, with square end stiffener 46A functioning as previously described. The gap 58 at the end of the groove 54A of the end panel can be filled with a separate component or left open.

The stiffener provides strength to the joint of the side and end panels, as described. It provides lengthwise stiffness to the side panel, reducing any tendency for distortion. It provides strength to the joints between the cross pieces and the side side panels. All these features substantially increase the strength of the rack.

The stiffener provides a further function in cooperation with slats 34 when they are present, by in combination providing a flat surface for supporting objects, such as household articles or a light, at the top of the rack. The stiffeners alone, without slats, are suitable for supporting a light, such as a fluorescent light with integral metal hood.

The stiffeners further provide a pleasing appearance when the rack interior is viewed from below. While the stiffeners are desirably rectangular in cross section, other cross section stiffeners can be used in the scope of the invention.

Figure 10:
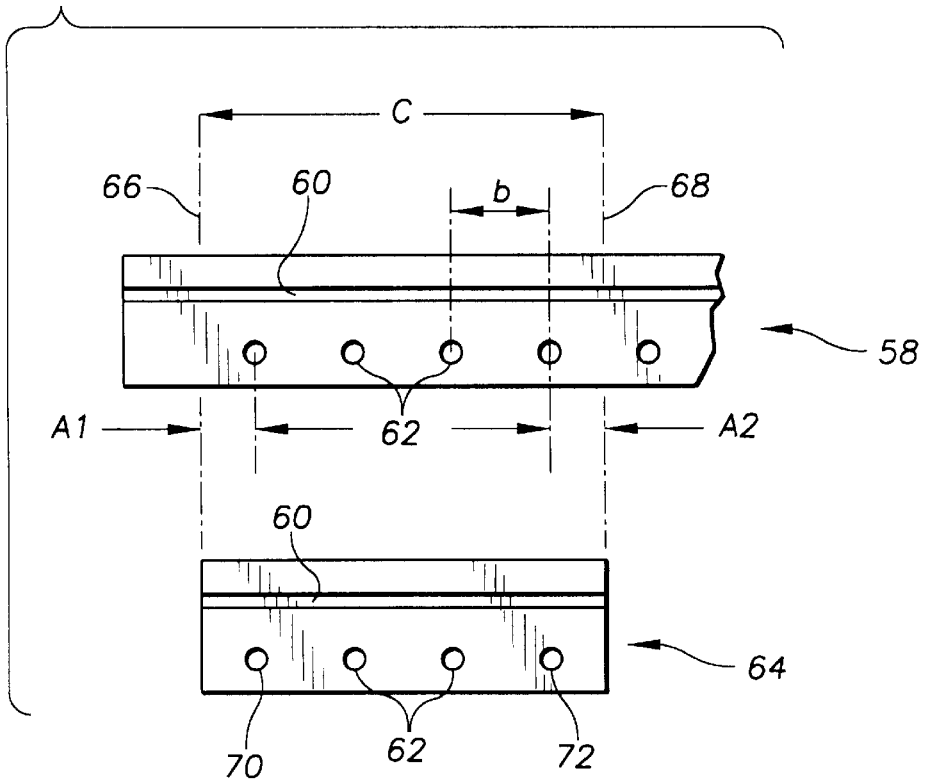
FIG. 10 illustrates how a custom length side panel having dowel holes can be easily manufactured from a precursor side panel piece.

Another feature of the invention is the convenience that obtains for custom sized racks. Precursor side panels of random length may be fabricated by mass-manufacturing. FIG. 10 illustrates how such a precursor side panel piece 58 is fabricated with groove 60 and a precision pattern of dowel holes 62. The holes are spaced apart a distance b, for instance, 12 inches, along a line running parallel to the length of the groove 60. suppose now that a customer wants a rack with side panel length c which is less than an even multiple of b, for instance 70 inches. To provide this, a precursor is cut along lines 66, 68 to make a portion of the precursor into side panel 64 having length c, where the distances A1 and A2 are each equal. A1 and A2 may be calculated by subtracting from c the dimension (n multiplied by b), where n is the whole number reflecting the most b dimensions that can be divided into c. Thus, the hole pattern is symmetrically located on the side panel, and the cross pieces that will be associated with the hole pattern will be symmetrically located within the interior space of the frame. For a rectangular frame, two side panels will be required. Depending on the length of the side panel, one or two precursor panels may be needed. The side panels which are cut from the precursor panels may be cut square, so butt joints are formed—in which case stepped stiffeners may be used; or they may be cut on an angle, so a miter joint corner may be made.

This procedure compares with the prior art method of cutting a partially fabricated panel to the desired custom length, and then drilling holes 62 so they are at equal distances from the ends and each other. In the invention, the end cross piece dowel holes 70, 72 (and corresponding cross pieces) are typically at a distance from the end panels which is less than the distance between adjacent cross pieces, since most times the total length is not an even multiple of dimension b. Since the lesser distances are equal, the effect is nonetheless esthetically pleasing. A stiffener having a length for a custom-length side panel is easily fabricated by simple carpentry, even when the step is present. The pre-fabrication of the side panel precursor with cross piece dowel holes ensures that the cross pieces will fit properly relative to the side panels and the stiffener, particularly with respect to vertical elevation, so the cross piece nicely contacts the stiffener. At the same time the stiffener and groove interlocking ensures that the corner joint will be properly aligned and strong. Should dowels be desired at the corner joints, the holes for such must of course be drilled after the piece 64 is cut from the precursor panel, but even so, doing is a less demanding than is the custom fabrication process than in the prior art. In like manner, the end panels and cross pieces can be simply cut from longer pre-fabricated parts, to custom size the width of the rack. The rack can be shipped in factory assembled or unassembled condition. In the field, an unassembled, or knocked down rack, can be modified as just described.

Figure 12A:
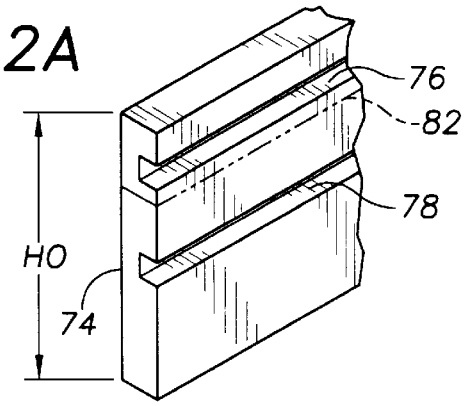
FIG. 12A, 12B and 12C illustrate different height side panels can be fabricated from a mass produced standard side panel.
Figure 12B:
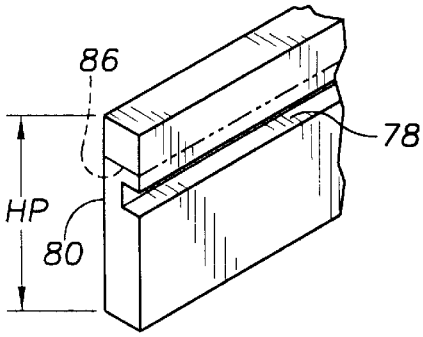
Figure 12C:
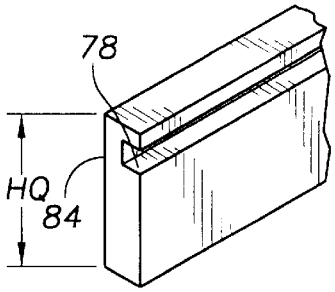

FIGS. 12A–12C show how side panels and end panels may be fabricated as large pieces and cut after fabrication to change the height of rack. FIG. 12A shows a side panel 74 having two stiffener grooves 76, 78 and height HO may be fabricated to a panel 80 having height HP, as shown in FIG. 12B but cutting along line 82. FIG. 12C shows how the panel 80 in FIG. 12B, whether fabricated from panel 74, or made as an original piece, may be further fabricated into panel 84 having height HQ, by cutting along line 86.

While the above-described round bars with slidable hooks for kitchenware comprise the preferred design, other prior art ways for supporting the kitchenware hooks may be part of the design. For instance, the hooks may be slidable within lengthwise slots in a wood piece, e.g., a wide slat, contained within the frame, or the hooks may be fixedly attached to the slats.

While the frame is desirably supported by hanging from vertical chains or rods, it may be cantilevered off a vertical surface, or mounted with a combination of chain and cantilever, or mounted off two parallel or angled vertical wall surfaces, or fastened to the underside of a shelf, and so forth.

While I have described bars for carrying hooks, other means for carrying hooks may be used in the generality of my invention. For instance, the hooks may be supported in grooves or channels in relatively heavy lengthwise wood pieces.

While I have described my invention in terms of a kitchen rack, its use is not limited to such. In some instances racks are used in exterior locations, and the durability of glue becomes limiting. With the invention and the various interlocking features described above, a rack can be fabricated using serrated plastic dowels to join the several components, and without the use of any glue at all.

Although only the preferred embodiment has been described with some alternatives, it will be understood that further changes in form and detail may be made without departing from the spirit and scope of the claimed invention.

I claim:

1. In a rack of the type comprised of a open frame defining a space, within which are members for supporting a multiplicity of suspended hooks, wherein the hooks are adapted to hold kitchenware and the like, the improvement comprising:

a frame comprised of a side panel and an end panel joined together to form a corner joint;

the end panel having a lengthwise groove facing toward the space; and, a stiffener running lengthwise along the surface of the side panel and projecting into the space, the end of the stiffener mating with the groove of the end panel, to create a strong joint.

2. The rack improvement of claim 1 wherein the side panel has a lengthwise groove in which the stiffener runs.

3. The rack improvement of claim 1 wherein the stiffener runs only a portion of the length of the side panel.

4. The rack improvement of claim 2 wherein the joint between the end panel and the side panel is a butt joint, formed by butting an end of the end panel to a side of the side panel; the groove running through the butt joint; further characterized by the stiffener having a stepped end with a tab projecting therefrom, the tab filling the groove where it runs through the butt joint.

5. The rack improvement of claim 1 wherein the rack frame is rectangular having four similar right angle corner joints.

6. The rack improvement of claim 1 characterized by at least one slat running lengthwise to the side panel, the end of the slat positioned in the groove of the end panel; wherein the elevation of the top of the slat is at the same elevation as the top of the stiffener.

7. The rack improvement of claim 1, wherein said members comprise at least one bar running parallel to and spaced apart from said side panel, the bar supported by at least one cross piece running transverse to the side panel, the end of the cross piece butting against and attached to the side panel; the cross piece having a side surface in contact with the stiffener where it projects into the space from the surface of the side panel.

8. The rack improvement of claim 7 wherein said cross piece end is attached to the side panel by means comprising a single dowel; wherein, said contact of the cross piece with the stiffener inhibits rotation of the cross piece.

9. A rack for hanging kitchen utensils from hooks comprising a rectangular frame, defining a space, comprised of a pair of opposing end panels and a pair of opposing side panels, the panels joined at corners to form four joints;

each side panel having a vertical surface with a groove running lengthwise thereupon;

each end panel having a lengthwise groove;

two stiffeners, each stiffener inserted within the groove of a side panel, so a portion of the cross section of the stiffener projects inwardly from a vertical surface of the side panel and into said space;

each stiffener having opposing ends inserted into the grooves of opposing end panels in vicinity of said corner joints, to strengthen the joints;

at least one cross piece running between the opposing side panels, the cross piece fastened at each end to the surface of the side panel and to the cross section of the stiffener which projects inwardly into said space; and, at least one bar, for supporting hooks, running from one end panel to the other, the cross piece supporting the bar at a point along the bar length.

10. The rack of claim 9 wherein the ends of the groove in each side panel terminate a short distance from the end of the side panel; and, wherein the corner joints are butt joints, formed by mating the ends of the end panels against the vertical surfaces of the side panels.

11. The rack of claim 9 further comprising corner joints which are butt joints, formed by mating the ends of the end panels against the vertical surfaces of the side panels;

side panels having grooves extending the full length of each panel;

each stiffener having opposing stepped ends comprising a tab projecting lengthwise; and, wherein each stiffener tab fills the groove within the butt joint.

12. The method of fabricating a rack of the type comprised of a rectangular frame having four corner joints, enclosing a space, the rack having members positioned within the space to support a multiplicity of hooks, wherein the hooks are adapted to hold kitchenware and the like, which comprises:

forming two end panels having lengthwise grooves;

forming one or more side panel precursors, each precursor having a surface with a lengthwise groove, and pattern of equally spaced apart dowel holes in the surface lying along a line parallel to the groove;

cutting two side panels of desired length from the one or more side panel precursors, so the dowel holes in each side panel are symmetrically located between the ends of the side panels; and, assembling the side panels and end panels to form said rectangular frame, having corner joints, while (a) providing and inserting stiffeners into the grooves of the side panels, so each stiffener cross section projects from the surface of the side panel into said space, and so the ends of the stiffeners project into the grooves of the end panels at the corner joints; and, (b) providing and positioning one or more cross pieces between the opposing side panels within the space; attaching each end of a cross piece to the surface of one of the opposing side panels by means of a dowel at the end of the cross piece, the dowel fitted into one of said dowel holes of the side panel, so the cross piece end is held in close contact with to the cross section of the stiffener which projects from the surface of the panel.

13. The method of claim 12 wherein the spacing between the holes at each end of the side panel and the cut ends of the side panel are less than the hole-to-hole spacing.

14. The method of claim 12 further comprising:

forming the side panel precursor of a board which provides the frame with a first height; and, cutting the side panel lengthwise, parallel to the groove, prior to the assembling step, to provide the side panel with a desired height which is less than the first height.

15. The method of claim 14 further comprising forming the panel with two grooves, wherein during the cutting step a portion of the panel is removed which contains one of the grooves.

16. The method of claim 12 wherein the corner joints are butt joints; wherein each stiffener has a tab projecting from each end; further comprising, inserting the tab of the stiffener within the groove of the side panel at the butt joint location.

* * * * *